US006386659B1

(12) United States Patent
Müller et al.

(10) Patent No.: US 6,386,659 B1
(45) Date of Patent: May 14, 2002

(54) LATCHABLE DRAWER SLIDE

(75) Inventors: Torsten Müller, Hilchenbach; Rüdiger Thomas, Haiger, both of (DE)

(73) Assignee: Westfalia Metallformtechnik GmbH & Co., Hilchenbach (DE)

( * ) Notice: Subject to any disclaimer, the term of this patent is extended or adjusted under 35 U.S.C. 154(b) by 0 days.

(21) Appl. No.: 09/709,746

(22) Filed: Nov. 9, 2000

(30) Foreign Application Priority Data

Nov. 10, 1999 (DE) ..... 299 19 738 U
May 6, 2000 (DE) ..... 100 22 197

(51) Int. Cl.[7] ..... A47B 88/04
(52) U.S. Cl. ..... 312/334.38; 312/334.6
(58) Field of Search ..... 312/330.1, 334.31, 312/334.27, 334.33, 334.34, 334.36, 334.37, 334.38, 334.1, 334.6

(56) References Cited

U.S. PATENT DOCUMENTS

| | | | | |
|---|---|---|---|---|
| 3,017,227 A | | 1/1962 | Thornton | |
| 3,022,129 A | * | 2/1962 | Manson | 312/334.38 |
| 3,272,583 A | * | 9/1966 | Averdieck | 312/334.38 |
| 4,494,802 A | | 1/1985 | Henson | |
| 4,981,278 A | | 1/1991 | Rees | |

FOREIGN PATENT DOCUMENTS

| | | |
|---|---|---|
| GB | 173383 | 1/1922 |

* cited by examiner

*Primary Examiner*—James O. Hansen
(74) *Attorney, Agent, or Firm*—Herbert Dubno; Andrew Wilford

(57) ABSTRACT

A drawer slide has an outer rail forming a plurality of parallel and inwardly open tracks, an inner rail fitting in the outer rail and having a plurality of flat surfaces each confronting and extending parallel to a respective one of the tracks, and a respective row of balls in each of the tracks and riding on the respective inner-rail surface. The outer rail has a normally horizontal bight portion having outer edges, respective planar lower side portions extending upward from the outer edges and forming therewith corners in turn forming tracks, respective planar upper side portions extending upward from upper edges of the lower side portions, and respective planar upper end portions extending inward from upper edges of the upper side portions and forming therewith corners in turn forming tracks. Similarly, the inner rail has a normally horizontal bight portion having outer edges, respective planar upper side portions extending downward from the outer edges and forming upper outer surfaces confronting the corners between the respective outer-rail upper end portions and outer-rail upper side portions, and respective planar lower side portions extending downward from lower edges of the inner-rail upper side portions and forming lower outer surfaces confronting the corners between the respective outer-rail lower side portions and the outer rail bight portion.

5 Claims, 3 Drawing Sheets

LATCHABLE DRAWER SLIDE

FIELD OF THE INVENTION

The present invention relates to a drawer slide. More particularly this invention concerns such a slide which can be latched in closed, partially open, and fully open positions.

BACKGROUND OF THE INVENTION

A standard drawer slide comprises a profiled rail that is fixed in the support, a complementary profiled rail that is attached to the drawer and that fits with the fixed rail, and a plurality of balls riding between the two rails. Normally two such slides extending parallel to each other and spaced apart transversely to the direction the drawer slides in are used to mount the drawer.

In the standard system the inner and outer rails of the slide are generally complementary and are formed with respective outwardly open and inwardly open track grooves in which the balls ride. This construction is fairly complex and, therefore, rather expensive, requiring both rails to be manufactured to very tight tolerances.

It is also known to provide some sort of latching mechanism on standard rails. This mechanism is normally also fairly complex and adds considerably to the overall bulk, in particular height, of the slide. While such a latch is required when a drawer is provided in a boat, truck, or airplane to prevent the drawer from sliding open when subjected to lateral G forces, it is in exactly this application that the extra space for the latch is not available or can be ill afforded. Thus recourse is normally had in these applications to a separate drawer latch.

OBJECTS OF THE INVENTION

It is therefore an object of the present invention to provide an improved drawer slide.

Another object is the provision of such an improved drawer slide which overcomes the above-given disadvantages, that is which is extremely compact and also very inexpensive to manufacture.

A further object is to provide an improved latch system for such a slide.

SUMMARY OF THE INVENTION

A drawer slide has according to the invention an outer rail forming a plurality of parallel and inwardly open tracks, an inner rail fitting in the outer rail and having a plurality of flat surfaces each confronting and extending parallel to a respective one of the tracks, and a respective row of balls in each of the tracks and riding on the respective inner-rail surface. Normally each of the flat surfaces is perpendicular to a bisector of the respective track corner.

Such construction is extremely simple. The balls ride on flat planar surfaces of the movable inner rail and in the corners of the fixed outer rail. These parts can be made relatively cheaply, yet will provide sure and smooth sliding action.

The outer rail according to the invention has a plurality of substantially planar portions together forming a plurality of corners forming the tracks. More specifically the outer rail has a normally horizontal bight portion having outer edges, respective planar lower side portions extending upward from the outer edges and forming therewith corners in turn forming tracks, respective planar upper side portions extending upward from upper edges of the lower side portions, and respective planar upper end portions extending inward from upper edges of the upper side portions and forming therewith corners in turn forming tracks.

Similarly, the inner rail has a normally horizontal bight portion having outer edges, respective planar upper side portions extending downward from the outer edges and forming upper outer surfaces confronting the corners between the respective outer-rail upper end portions and outer-rail upper side portions, and respective planar lower side portions extending downward from lower edges of the inner-rail upper side portions and forming lower outer surfaces confronting the corners between the respective outer-rail lower side portions and the outer rail bight portion. The upper and outer surfaces are generally perpendicular to each other and, as mentioned above, each perpendicular to a bisector of the respective outer-rail corner.

The portions form obtuse angles at the corners. Thus the balls will roll on two surfaces of the outer rail and one surface of the inner rail.

In accordance with the invention two such slides extending parallel to each other are provided with connecting struts extending horizontally between and fixed to the inner rails. A handle is pivotal about an axis transverse to the rails on the inner rails and carries a pair of fingers movable transversely of the rails on pivoting of the handle. Respective latch strips fixed to the outer rails are each formed with at least one vertically open latch hole in which the respective finger is engageable. In order that the drawer mounted on the struts can be arrested at any end or intermediate position, each of the latch strips is formed with a row of holes extending parallel to the respective rails.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
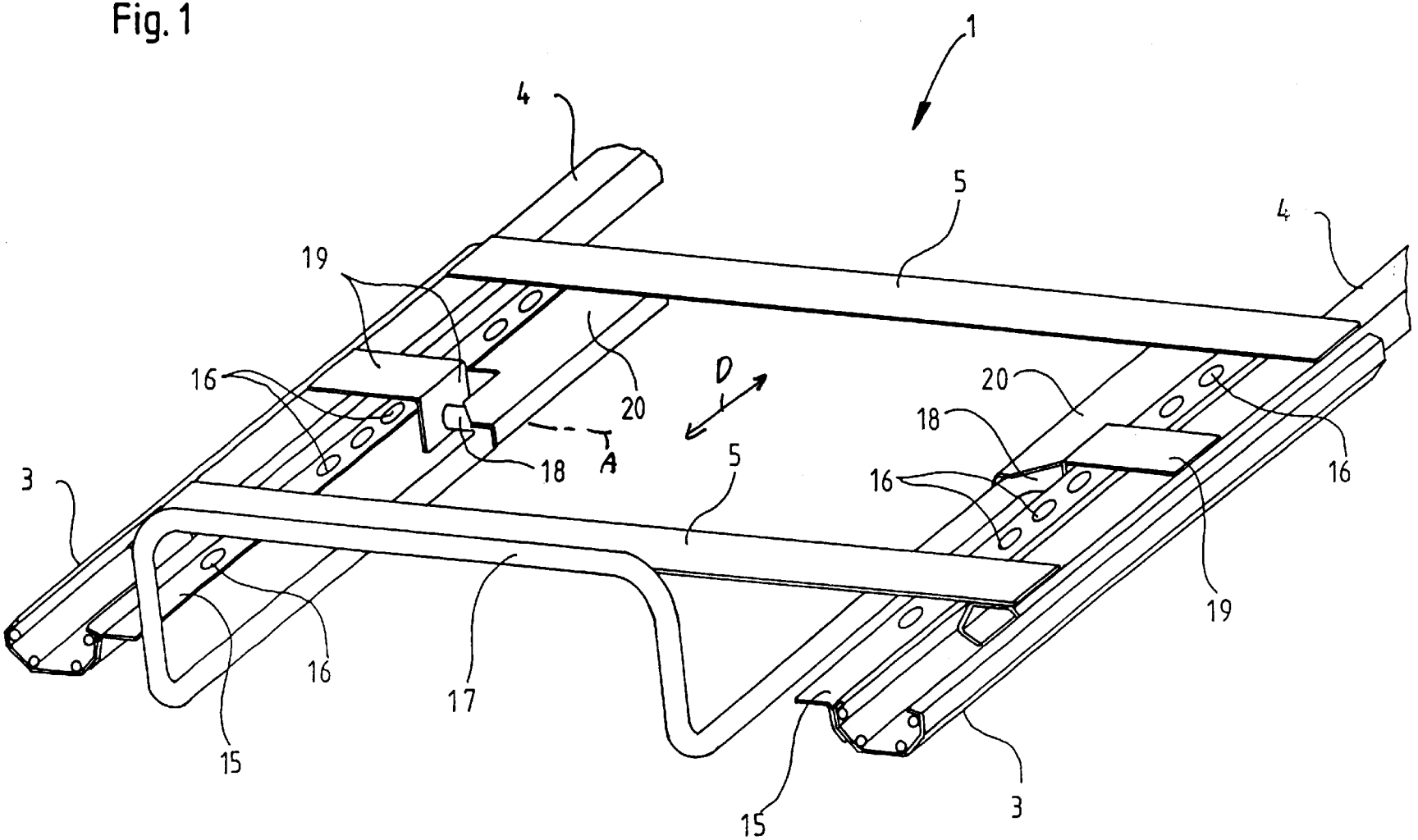
FIG. 1 is a perspective view of a drawer-slide assembly according to the invention.
Figure 2:
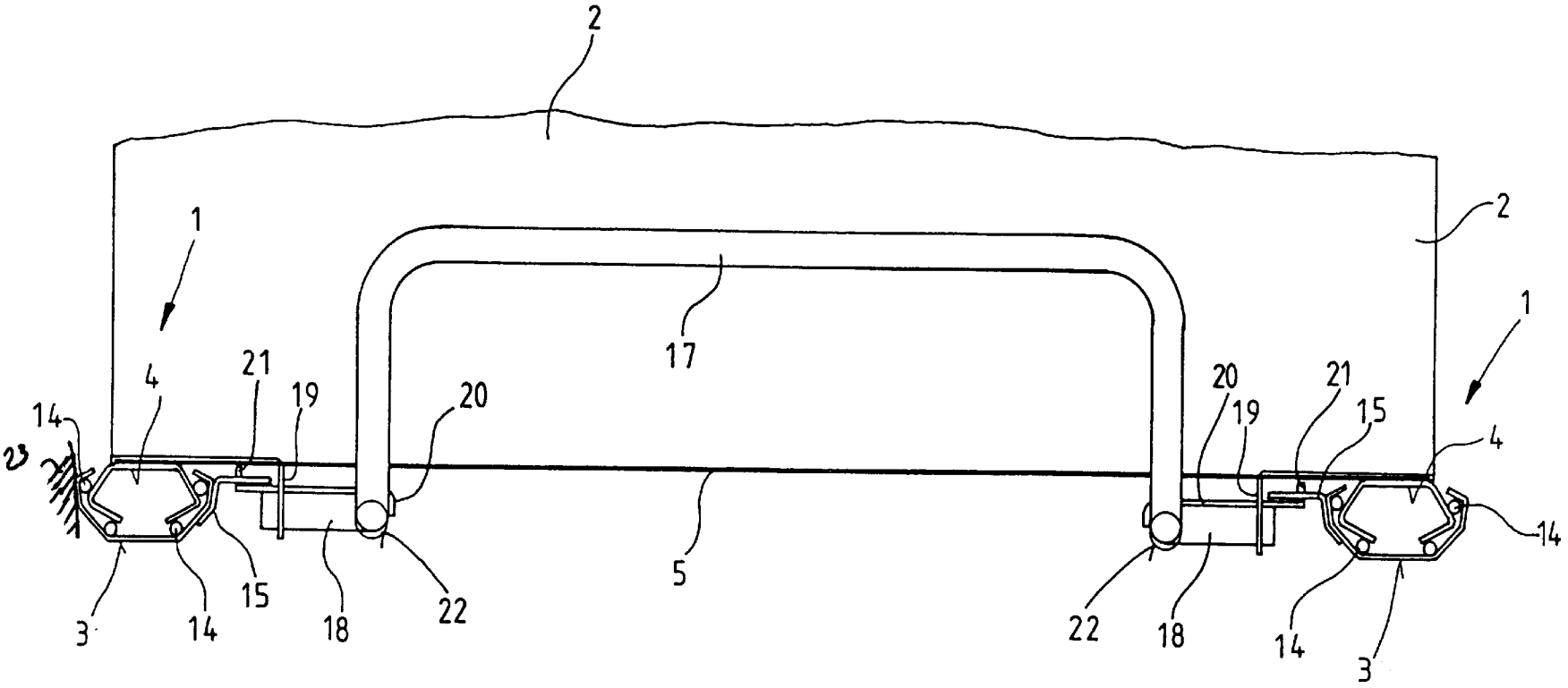
FIG. 2 is a front view of the drawer-slide assembly including a drawer.

As seen in FIG. 1 a drawer-slide assembly according to the invention comprises a pair of substantially identical slides 1 adapted to carry a drawer 2 (FIG. 2 only) and each comprising a lower or outer rail 3 of upwardly open U-section and an upper or inner rail 4 of downwardly open U-section, with four rows of balls 14 engaged between them for sliding in a horizontal direction D. Connecting struts 5 are welded to the two upper rails 4 and carry the drawer 2, the lower rails 3 being secured by unillustrated means in a wall or cabinet as illustrated schematically at 23 (FIG. 2).

Figure 3:
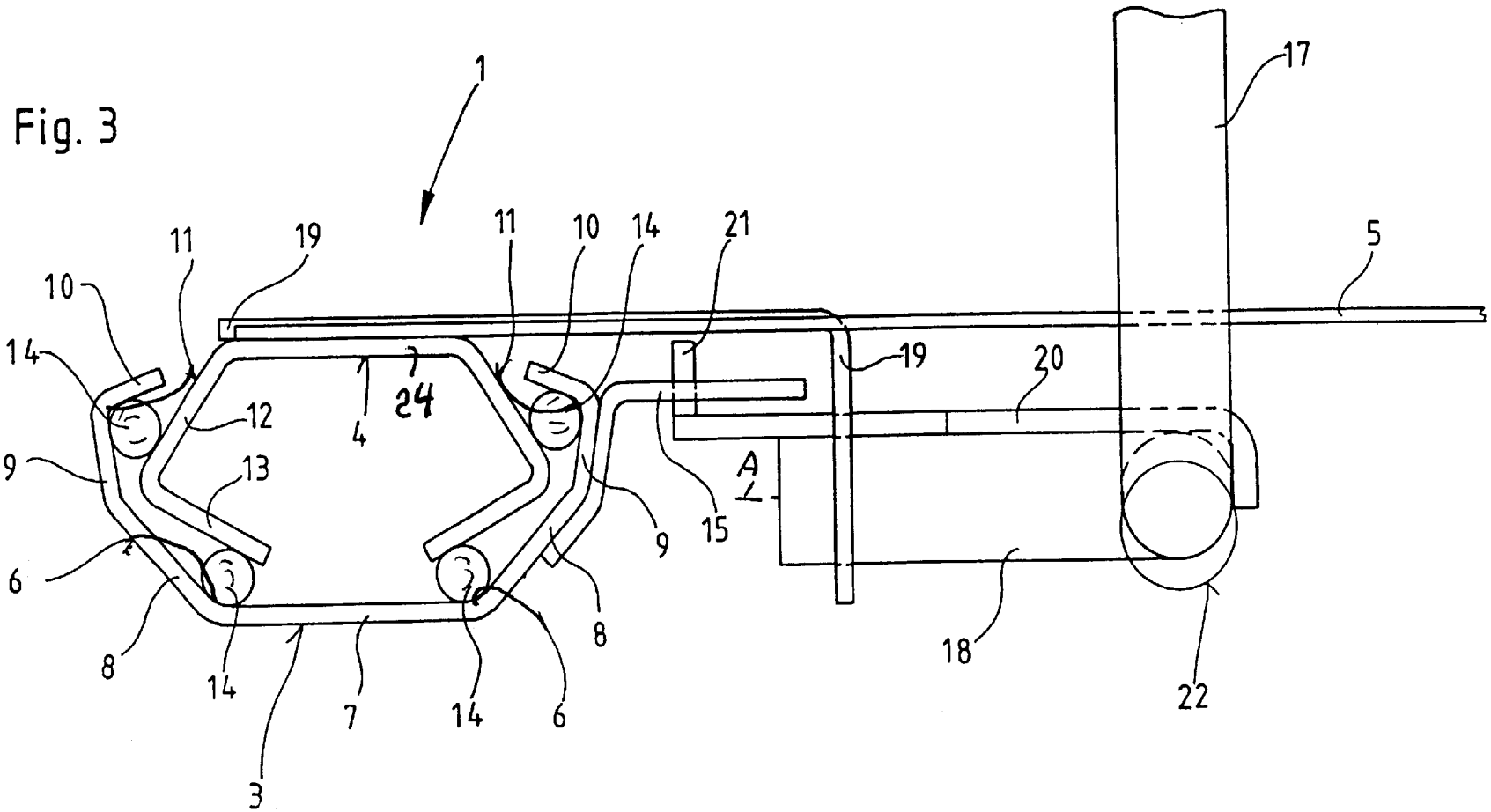
FIG. 3 is a large-scale front view of a detail of FIG. 1.

As best shown in FIG. 3, each lower rail 3 has a horizontal and planar bight portion 7 from whose outer edges extend two lower side portions 8 forming a large obtuse angle with the bight portion 7 and forming therewith corners 6. Extending upward from upper edges of the lower side portions 8 are upper side portions 9 forming an even larger obtuse angle with the respective lower side portions 8. Upper end portions 10 that are flat and planar like the portions 7, 8, and 9, extend inward at smaller obtuse angles from upper edges of the upper side portions 9 and form inwardly directed corners 11 therewith. The rail 3 is symmetrical about a vertical central plane.

The upper rails 4 each have a central horizontal and planar bight portion 24 from whose outer edges extend two upper side portions 12 forming an obtuse angle with the portion 24. Extending inward from lower ends of the upper side portions 12 are lower side portions 13 extending at about right angles to the respective upper side portions 12. The portions 12 and 13 are planar and have flat outer faces that confront the corners 11 and 6 and that extend perpendicular to bisectors of these corners 11 and 6. The balls 14 are in rows in the corners 6 and 11 bearing on the outer faces of the portions 12 and 13. Normally the balls 14 of each row are confined in respective seats of a strip-type cage that is not illustrated here and that is associated with unillustrated end stops of standard construction.

Each of the fixed lower rails 3 carries a generally L-section latch strip 15 having a horizontal flange formed with a row of holes 16 (FIG. 1) spaced apart in the direction D. Another pair of L-section brackets 19 fixed to the movable upper rails 4 each have a depending arm forming a pivot for an inner end 18 of a rod handle 17 extending past the front of the drawer and pivotal about an axis A perpendicular to the direction D. This handle 17 carries offset inward from the axis A a pair of horizontal plates 20 having upstanding pins or fingers 21 that can engage upward through the holes 16. When the handle 17 is raised at its outer end to move its inner end to the position indicated at 22 in FIG. 3, the plates 20 pivot down and disengage the fingers 21 from the holes 16, permitting the drawer 2 to slide in the direction D. When the handle 17 is down and the fingers 21 are engaged in the holes 16, the drawer 2 is effectively latched against sliding. The entire latch mechanism fits wholly between the plane of the upper surfaces of the inner rail 4 and the plane of the lower surfaces of the outer rails 3, so that it adds nothing to the height of the assembly.

The drawer 2 is opened by lifting the outer end of the handle 17 to pull the fingers 21 out of the holes 16 and then pulling outward on the handle 17 to slide inner rails 4 in the outer rails 3. At any point along the travel the handle 17 can be pivoted back up to lock the drawer 2 relative to the fixed outer rails 3.

We claim:

1. A drawer slide comprising:

an outer rail having a normally horizontal bight portion having outer edges, respective planar lower side portions extending upward from the outer edges and forming therewith corners in turn forming inwardly open tracks, respective planar upper side portions extending upward from upper edges of the lower side portions, and respective planar upper end portions extending inward from upper edges of the upper side portions and forming therewith corners in turn forming tracks, an inner rail fitting in the outer rail and having a plurality of flat surfaces each confronting and extending parallel to a respective one of the tracks, a normally horizontal bight portion having outer edges, respective planar upper side portions extending downward from the outer edges and forming upper outer surfaces confronting the corners between the respective outer-rail upper end portions and outer-rail upper side portions, and respective planar lower side portions extending downward from lower edges of the inner-rail upper side portions and forming lower outer surfaces confronting the corners between the respective outer-rail lower side portions and the outer rail bight portion;

a respective row of balls in each of the tracks and riding on the respective inner-rail surface.

2. The drawer slide defined in claim 1, wherein the portions form obtuse angles at the corners.

3. A drawer slide comprising:

a pair of parallel outer rails forming a plurality of parallel and inwardly open tracks;

a respective inner rail fitting in the outer rails and each inner rail having a plurality of flat surfaces confronting and extending parallel to a respective one of the tracks;

a respective row of balls in each of the tracks and riding on the respective inner/rail surfaces; and connecting struts extending horizontally between and fixed to the inner rails.

4. The drawer slide defined in claim 3, further comprising a handle pivotal about an axis transverse to the inner rails and carrying a pair of fingers movable transversely to the rails on pivoting the handle; and respective latch strips fixed to the outer rails and each latch strip being formed with at least one vertically open latch hole in which a respective finger of the pair of fingers is engageable.

5. The drawer slide defined in claim 4 wherein each of the latch strips is formed with a row of holes.

* * * * *